US006558211B2

(12) United States Patent
Freitag et al.

(10) Patent No.: US 6,558,211 B2
(45) Date of Patent: May 6, 2003

(54) LOW-PROFILE STEERING NOZZLE FOR WATER JET PROPULSION SYSTEM

(76) Inventors: Michael W. Freitag, 7110 23rd Ave., Kenosha, WI (US) 53143; James R. Jones, 2574 Jefferson Rd., Neosho, WI (US) 53059

( * ) Notice: Subject to any disclaimer, the term of this patent is extended or adjusted under 35 U.S.C. 154(b) by 0 days.

(21) Appl. No.: 09/928,062

(22) Filed: Aug. 11, 2001

(65) Prior Publication Data

US 2003/0032347 A1 Feb. 13, 2003

(51) Int. Cl.[7] ..... B63H 11/113
(52) U.S. Cl. ..... 440/42
(58) Field of Search ..... 440/38, 42, 43, 440/83

(56) References Cited

U.S. PATENT DOCUMENTS

| | | | | | |
|---|---|---|---|---|---|
| 3,481,303 | A | | 12/1969 | Tate et al. | 115/70 |
| 3,658,026 | A | * | 4/1972 | Jacobson | 440/42 |
| 3,776,173 | A | * | 12/1973 | Horwitz | 440/42 |
| 3,828,717 | A | * | 8/1974 | Nichols et al. | 440/42 |
| 4,643,685 | A | * | 2/1987 | Nishida | 440/42 |
| 4,917,637 | A | * | 4/1990 | Soga et al. | 440/42 |
| 5,395,272 | A | * | 3/1995 | Smith | 440/42 |
| 5,401,198 | A | * | 3/1995 | Toyohara et al. | 440/38 |
| 5,803,775 | A | * | 9/1998 | Henmi | 440/42 |
| 6,102,756 | A | * | 8/2000 | Michel et al. | 440/38 |
| 6,176,749 | B1 | * | 1/2001 | Kato | 440/38 |
| 6,287,162 | B1 | * | 9/2001 | Freitag et al. | 440/42 |
| 6,299,494 | B1 | * | 10/2001 | Bowers et al. | 440/42 |

* cited by examiner

*Primary Examiner*—S. Joseph Morano
*Assistant Examiner*—Lars A. Olson
(74) *Attorney, Agent, or Firm*—Ziolkowski Patent Solutions Group LLC

(57) ABSTRACT

A water jet propulsion system has a flow-through housing with an impeller section, a convergent section having a discharge aperture, and a cup-shaped extension. An impeller is rotatable within the impeller section of the housing. A steering nozzle is pivotably mounted inside the cup-shaped extension for pivoting about an axis. The steering nozzle has an inlet opening with a width greater than its height, a laterally convergent section extending rearward from the inlet opening, and an outlet opening. Preferably the outlet opening of the steering nozzle is generally circular. The steering nozzle has a second section having a passage which is generally cylindrical or slightly convergent. The second section ends at the outlet opening. A support post extends radially outward from the steering nozzle, and a steering arm extends laterally and forward from the support post. A portion of the steering arm extends outside of and overhangs a portion of the cup-shaped extension. The steering nozzle, support post and steering arm are formed as one cast piece.

38 Claims, 7 Drawing Sheets

LOW-PROFILE STEERING NOZZLE FOR WATER JET PROPULSION SYSTEM

FIELD OF THE INVENTION

This invention generally relates to water jet-propelled boats or other watercraft. In particular, the invention relates to jet-propelled boats or other watercraft which have a pivotable steering nozzle arranged to receive the pump discharge and divert the discharged water in a desired direction.

BACKGROUND OF THE INVENTION

It is known to propel a boat or other watercraft using a water jet apparatus mounted to the hull, with the powerhead being placed inside (inboard) the hull. An impeller is mounted on a shaft driven by a drive shaft of the motor, and is housed in a duct having an inlet and an outlet. The impeller is designed such that during motor operation, the rotating impeller impels water rearward through the duct. The water discharged from the duct outlet produces a thrust which propels the boat forward.

In addition, it is known to provide a mechanism for diverting the discharged water flow to one side or the other of a midplane, thereby enabling the boat operator to steer the boat to the left or right during forward propulsion. One such mechanism is a steering nozzle pivotably mounted to the duct and in flow communication with the duct outlet. Preferably the pivot axis of the steering nozzle lies in the midplane. As the steering nozzle is pivoted to the left of a central position, the water flow out of the duct is diverted leftward, producing a thrust which pushes the water jet apparatus and the boat stern to the right, thereby causing the bow of the boat to turn to the left. Similarly, the boat bow turns to the right when the steering nozzle is pivoted to the right of the central position. The overall length of the propulsion unit is reduced when the steering function is accomplished by the discharge nozzle. In other words, the stator discharge is drawn together by a converging cone which also pivots to the sides for steering.

It is also known to provide a mechanism for reversing the direction of the water flow exiting the steering nozzle. In accordance with some known designs, the reverse gate is not steerable, i.e., the reverse gate is pivotably mounted to the fixed stator housing or exit nozzle. In the up position, the reverse gate is clear of the water flow exiting the steering nozzle; in the down position, the reverse gate obstructs the water flow exiting the steering nozzle and reverses the rearward flow component. Some non-steerable designs also reverse the lateral flow component; others do not. The non-steerable reverse gate designs which reverse the lateral flow component cause the rearward-moving boat to turn left when the steering nozzle is turned to the left and to turn right when the steering nozzle is turned to the right.

During pivoting of the reverse gate from its stored position to its fully deployed position or vice versa, the reverse gate must clear the aft upper edge of the steering nozzle. Typically, the center of rotation of the reverse gate is located at the intersection of horizontal plane which bisects the steering nozzle and a vertical plane which intersects the pivot axis of the steering nozzle. The greater the height of the steering nozzle, the greater the radius from the reverse gate pivot axis to the forward edges (upper and lower) of the reverse gate must be in order to ensure that the forward edge of the reverse gate clears the aft upper edge of the steering nozzle. Thus there is a need to provide a steering nozzle having a reduced vertical height, which would allow a corresponding reduction in the radius from the pivot axis to the forward edges of the reverse gate.

A reduction in the latter radius reduces the overall length of reverse gate measured from its pivot axis to its aftmost point. Additionally, the amount of vertical clearance which is needed for the reverse gate in the fully up or stored position would be reduced. This is beneficial in boats designed with a swim platform extending in cantilever fashion from the stern. Even for boats which do not incorporate structure overhanging the stored reverse gate, it is desirable to reduce the vertical height of the stored reverse gate, and the length of the deployed reverse gate, to minimize the extent to which the reverse gate presents an obstacle.

SUMMARY OF THE INVENTION

The present invention is directed to a jet-propelled boat comprising a water jet propulsion unit having a low-profile steering nozzle. In particular, the steering nozzle has an inlet opening with a width greater than its height, the vertical height of the steering nozzle inlet is reduced without reducing the volumetric flow rate through the inlet. This reduction in the height of the steering nozzle allows a corresponding reduction in the radius from the reverse gate pivot axis to the forward edges (upper and lower) of the reverse gate without compromising clearance vis-à-vis the aft upper edge of the steering nozzle.

In accordance with one preferred embodiment of the invention, the water jet propulsion system comprises a flow-through housing having an impeller section, a convergent section having a discharge aperture, and a cup-shaped extension; an impeller which is rotatable within the impeller section of the housing; and a steering nozzle pivotably mounted inside the cup-shaped extension for pivoting about an axis. The steering nozzle has an inlet opening with a width greater than its height, a laterally convergent section extending rearward from the inlet opening, and an outlet opening. Preferably the outlet opening of the steering nozzle is generally circular. The steering nozzle further comprises a second section having a passage which is generally cylindrical or slightly convergent. The second section ends at the outlet opening.

In accordance with a further feature of the preferred embodiment, a support post extends radially outward from the steering nozzle, and a steering arm extends laterally and forward from the support post. A portion of the steering arm extends outside of and overhangs a portion of the cup-shaped extension. Preferably the steering nozzle, support post and steering arm are formed as one cast piece. A longitudinal reinforcement rib can be integrally formed on the exterior of the steering nozzle, integrally connected to the support post.

The steering nozzle is pivotably mounted inside the cup-shaped extension by means of a pair of coaxial pivot pins placed at the top and bottom of the extension. In cases where the impeller shaft is inclined, i.e., not horizontal, the pivot pin axis is preferably perpendicular to the impeller axis of rotation, while the centerline axis of the steering nozzle is preferably horizontal, i.e., not parallel to the impeller axis of rotation. In accordance with the preferred embodiment, this is accomplished by fabricating a steering nozzle having a centerline axis which is not perpendicular to the common axis of the pivot holes which receive the pivot pins. In cases where the impeller shaft is horizontal, then the centerline axis of the steering nozzle is preferably coaxial with the impeller axis of rotation.

The invention is further directed to a jet-propelled boat having a water jet propulsion system of the foregoing type.

DETAILED DESCRIPTION OF THE PREFERRED EMBODIMENTS

Figure 1:
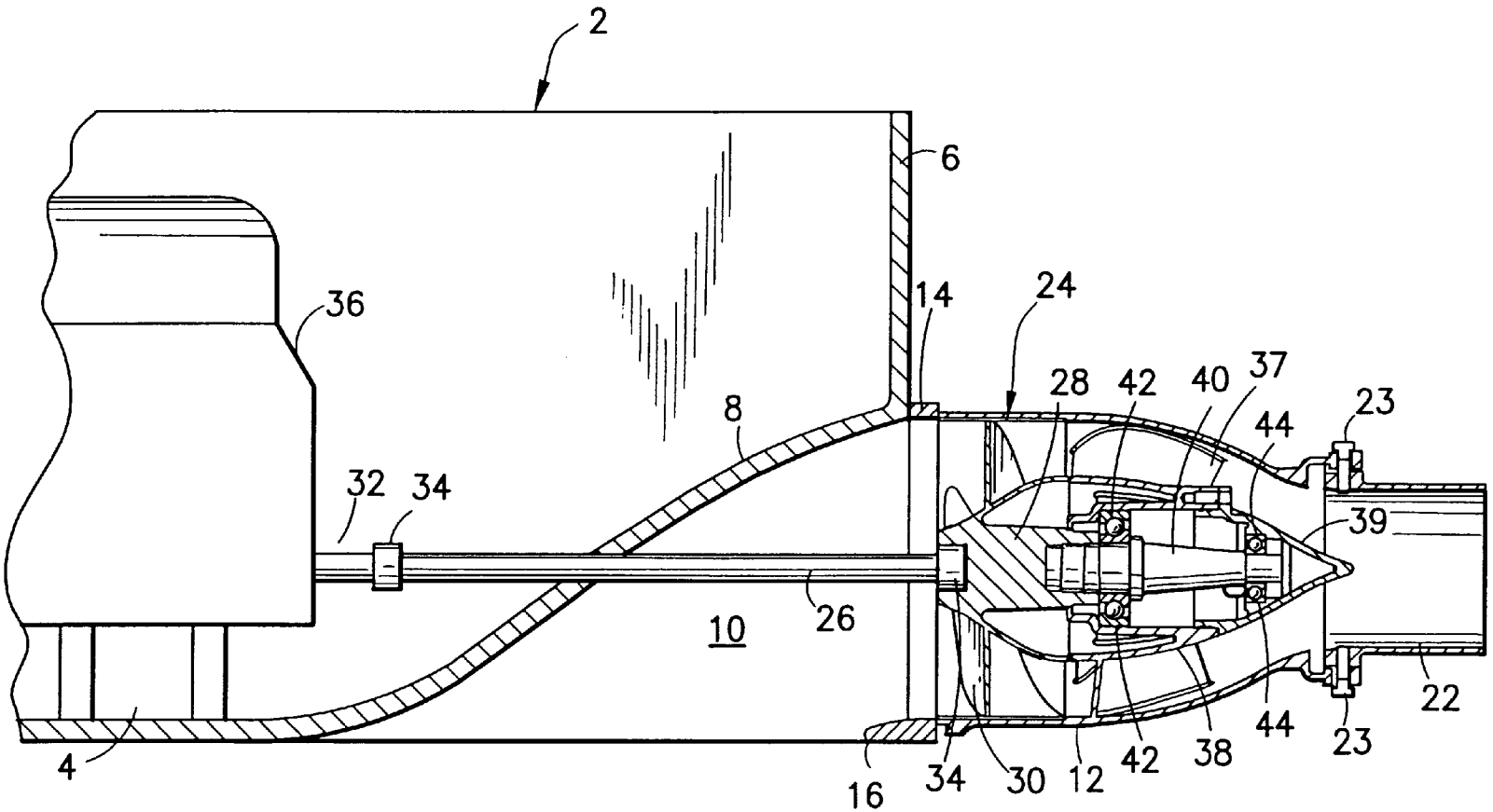
FIG. 1 is a schematic showing a sectional view of the stern portion of a boat or watercraft having a water jet propulsion system in accordance with one preferred embodiment of the invention.

The stern portion of a jet-propelled boat in accordance with a preferred embodiment of the invention is shown in FIG. 1. A hull 2 comprises a bottom 4, a stern wall or transom 6, an inlet ramp 8 integrally formed in the hull bottom, and a bow (not shown). Preferably the hull is fabricated in a mold by applying a lamination of fiberglass matting and resin and then allowing the laminate to cure. The inlet ramp 8 is formed as part of the hull bottom during the molding operation. The inlet ramp 8 increases continuously in height from a starting point at the hull bottom 4 to a maximum height at the transom 6. The inlet ramp defines an inlet channel 10 which is open at the hull bottom and at the transom. Alternatively, the hull can be made of metal, e.g., aluminum alloy.

In accordance with the boat design depicted in FIG. 1, a water jet propulsion assembly is mounted to the transom 6 by means of a mounting adapter 14. The water jet propulsion assembly is cantilevered from mounting adapter 14, which is mounted to the rear face of the transom 6 by fasteners (not shown). Preferably, mounting adapter 14 is a flanged ring having a rounded lower lip 16. The bottom edges of the inlet ramp 8 and the leading edge of the lower lip 16 define an inlet opening for entry of ambient water into the inlet channel 10.

The water jet propulsion assembly comprises an integrally formed stator housing/exit nozzle 12 fastened to the mounting adapter 14. Alternatively, the stator housing and exit nozzle may be separate components. The exit nozzle discharges the impelled water into a steering nozzle 22. The steering nozzle is pivotably mounted to the exit nozzle. The inlet of the steering nozzle 22 is in flow communication with the inlet opening via the inlet ramp 8, the mounting adapter 14, and the stator housing/exit nozzle 12.

As seen in FIG. 1, the water jet propulsion assembly typically comprises an impeller 24 coupled to the driven shaft 26 via a flexible coupling 34. The impeller typically comprises an impeller hub 28 coupled to a splined end of the driven shaft 26 for rotation therewith and a plurality of impeller blades 30 which extend generally radially outward from the hub. The impeller blades 30 are spaced at equal angular intervals around the circumference of the impeller hub 28. Preferably the hub and blades of impeller 24 are integrally formed as one cast piece. The outer surface of the impeller hub 28 forms a radially inner boundary for guiding the flow of water through the impeller housing.

Referring to FIG. 1, the driven shaft 26 is driven to rotate by a drive shaft 32 coupled thereto via another flexible coupling 34. The drive shaft 32 is driven to rotate by a motor 36 mounted inside the hull 2, which in turn causes the driven shaft and attached impeller to rotate. As generally depicted in FIG. 1, the driven shaft 26 penetrates the inlet ramp 8, although the means by which this penetration is accomplished are not shown.

Still referring to FIG. 1, the rotating impeller 24 impels water rearward into the stator section. The stator housing/exit nozzle 12 is preferably a cast piece which further comprises a stator hub 38 and a plurality of stator vanes 37 extending radially from the stator hub to the stator housing. A tail cone 39 is attached to the stator hub 38. The impeller hub 28 sits on the threaded end of a short shaft 40 which is rotatably supported by bearings 42 in the stator hub 38 and bearings 44 in the tail cone 39. The stator section restrains the free-spinning impeller from thrusting forward during operation. The outer surface of the stator hub 38 forms a radially inner boundary for guiding the flow of water through the stator housing. The stator vanes 37 are designed to redirect the swirling flow out of the impeller 24 into non-swirling flow. The straightened flow flows through the convergent steering nozzle, which increases the water velocity.

Although FIG. 1 shows one housing for the impeller and stator sections, it will be readily appreciated by persons skilled in the art that separate housings may be used.

Still referring to FIG. 1, the steering nozzle 22 is pivotably mounted to the stator by means of a pair of pivot pins 23 which are coaxial with a vertical axis. This allows the steering nozzle 22 to be pivoted from side to side for directing thrust to one side or the other for the purpose of steering the boat. The water exiting the steering nozzle creates a reaction force which propels the boat forward. To simplify the drawing, the levers, rods and cables for controlling the angular position of steering nozzle 22 are not shown. Also, the reverse gate and associated levers, rods and cables have not been shown. In accordance with the preferred embodiment, the steering nozzle inlet has a width greater than its height.

The preferred embodiment of the invention is shown in more detail in FIGS. 2–7. It will be assumed that the driven shaft (26 in FIG. 1) is inclined relative to a horizontal axis, while the centerline axis of the steering nozzle is coaxial with that horizontal axis.

Figure 2:
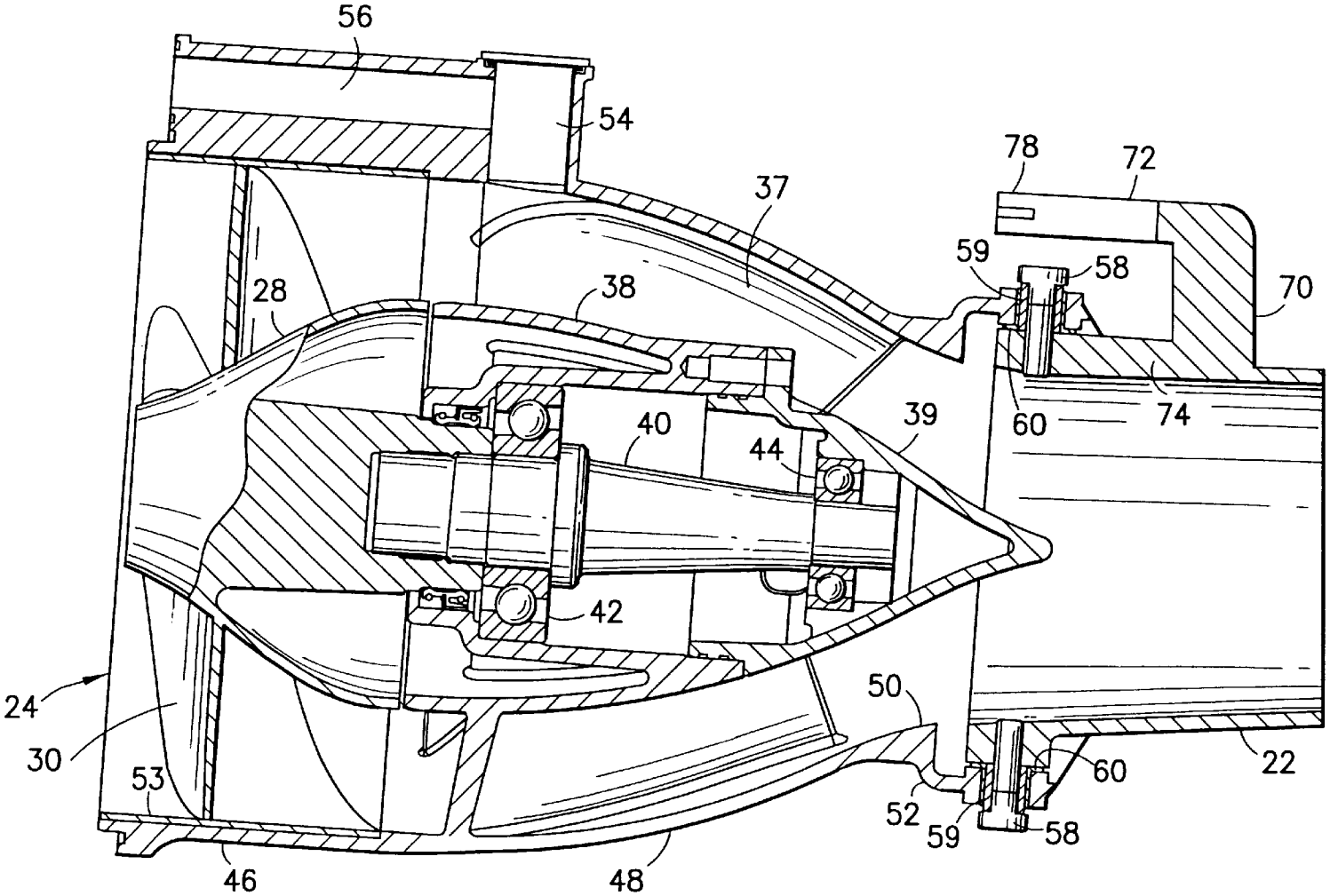
FIG. 2 is a schematic showing a vertical sectional view of portions of a water jet propulsion system in accordance with another preferred embodiment of the invention.

Referring to FIG. 2, it can be seen that the flow-through housing 12 in accordance with a preferred embodiment comprises an impeller section 46 which houses the impeller 24; a stator section 48 having a stator integrally formed inside; a discharge aperture 50 representing the point of minimum cross-sectional area of the interior surface of the stator housing; and a cup-shaped extension 52. The flow-through passage inside housing 12 comprises a generally annular volume between the external surface of the impeller hub 28 and a wear ring 53 seated in an annular recess in the housing 12; a generally annular volume between the external surface of the stator hub 38 and the opposing interior surface of the housing 12; and a generally annular volume between the tail cone 39 and the opposing interior surface of the housing 12, ending at the discharge aperture 50. A portion of the interior surface of housing 12 is convergent from a point behind the impeller up to the discharge aperture 50. Although not relevant to the present invention, FIG. 2 also shows a vertical channel 54 which communicates with the flow-through passage via a screen (not shown). The vertical channel 54 in turn communicates with a horizontal channel 56 which communicates with a channel leading to the engine. Cooling water is supplied to the engine from the pump jet unit via channels 54 and 56, the water being pushed through the low-pressure channels 54 and 56 by the high pressure behind the impeller.

As seen in FIG. 2, the inlet end of the steering nozzle 22 is pivotably mounted inside the cup shaped extension 52 by means of a pair of pivot pin assemblies located at the top and bottom of the cup-shaped extension. Each pivot assembly comprises a screw 58, a sleeve 59 and a bushing 60. The axes of the screws 58 are collinear and form a pivot axis about which the steering nozzle 22 can rotate. In particular, the cup-shaped extension 52 has a pair of circular holes in which the bushings 60 are seated. The sleeves 59 are inserted inside the respective bushings 60. The screws 58 are in turn inserted in the sleeves and screwed into respective threaded holes in the steering nozzle 22. The pivot axis is generally perpendicular to the axis of rotation of the impeller.

Figure 4:
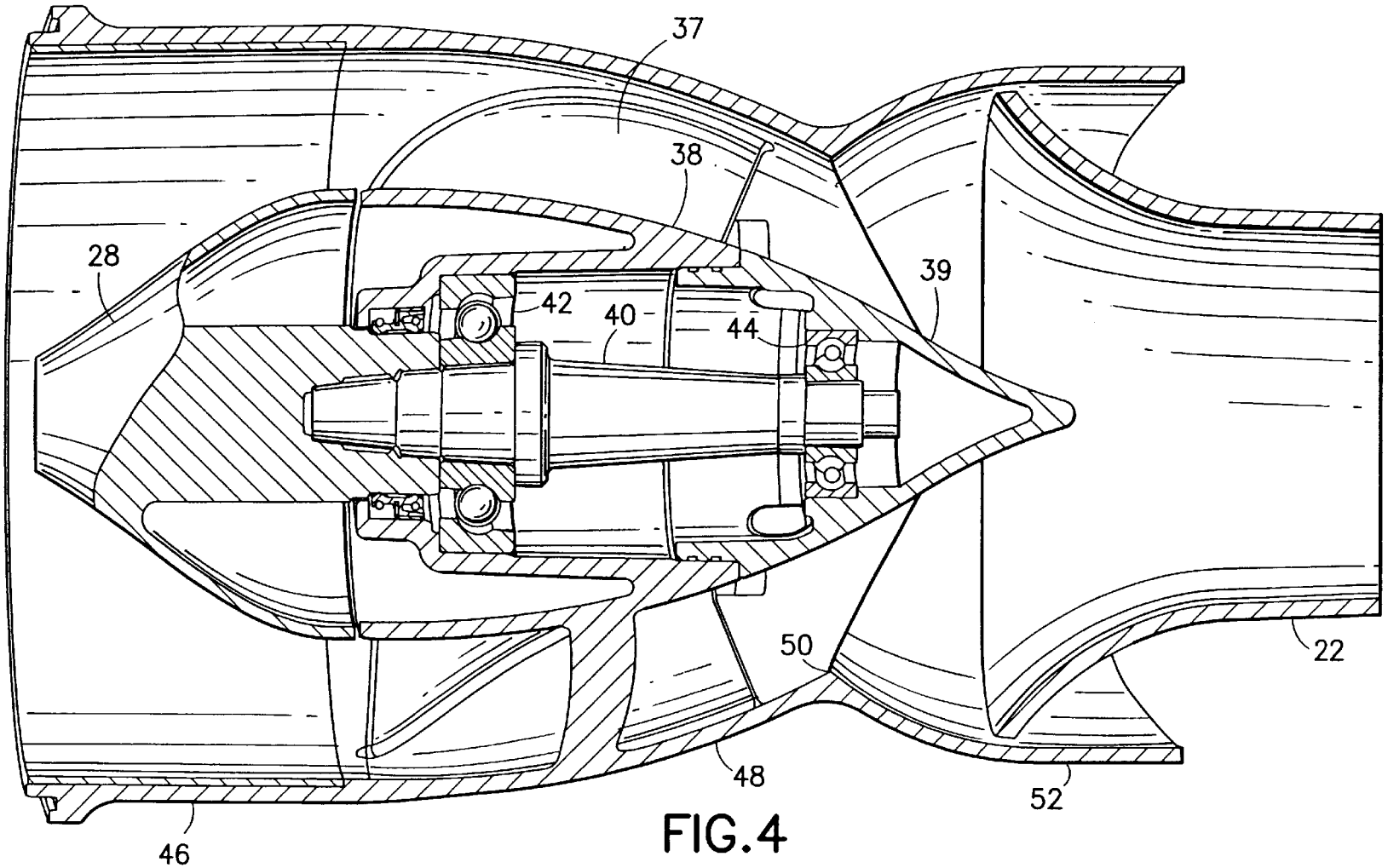
FIG. 4 is a schematic showing a horizontal sectional view of the water jet propulsion system depicted in FIG. 2.
Figure 5:
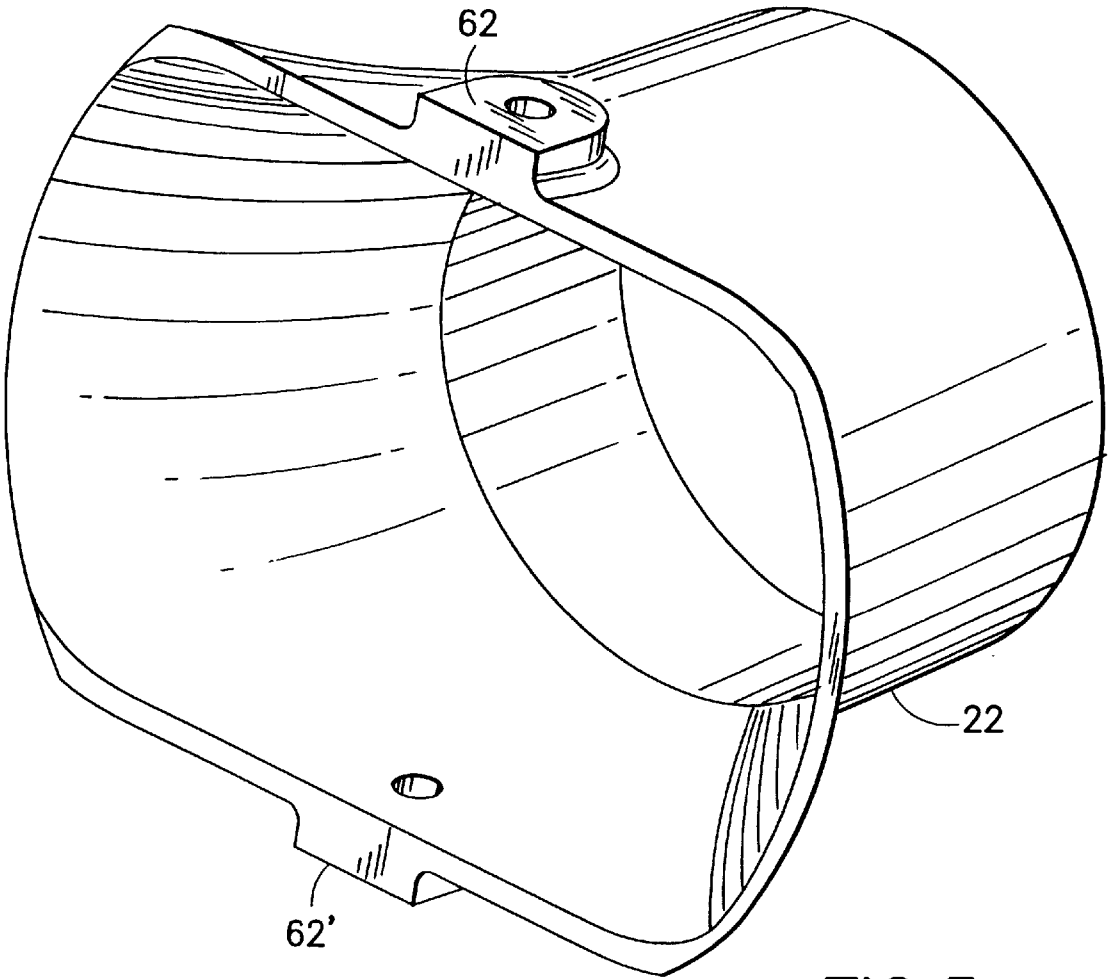
FIG. 5 is a schematic showing an isometric view of a steering nozzle in accordance with the preferred embodiment depicted in FIG. 2.

The steering nozzle preferably has a passage with a forward section, beginning at the nozzle inlet opening, which is slightly vertically convergent (as shown in FIG. 2) and highly laterally convergent (as shown in FIG. 4). The remainder of the steering nozzle passage is preferably cylindrical or slightly convergent, ending with a generally circular outlet opening (best seen in FIG. 7). As best seen in FIG. 5, the inlet opening of the steering nozzle 22 has a width greater than its vertical height. The preferred geometric shape of the inlet opening of the steering nozzle is a circle which is truncated at the top and the bottom. FIG. 5 shows a steering nozzle having a pair of bosses 62 and 62' which reinforce the steering nozzle wall in the area of the threaded holes which receive the threaded pivot pins. The top boss 62 may be integrally formed with a reinforcement rib, as will be described in detail below.

Figure 6:
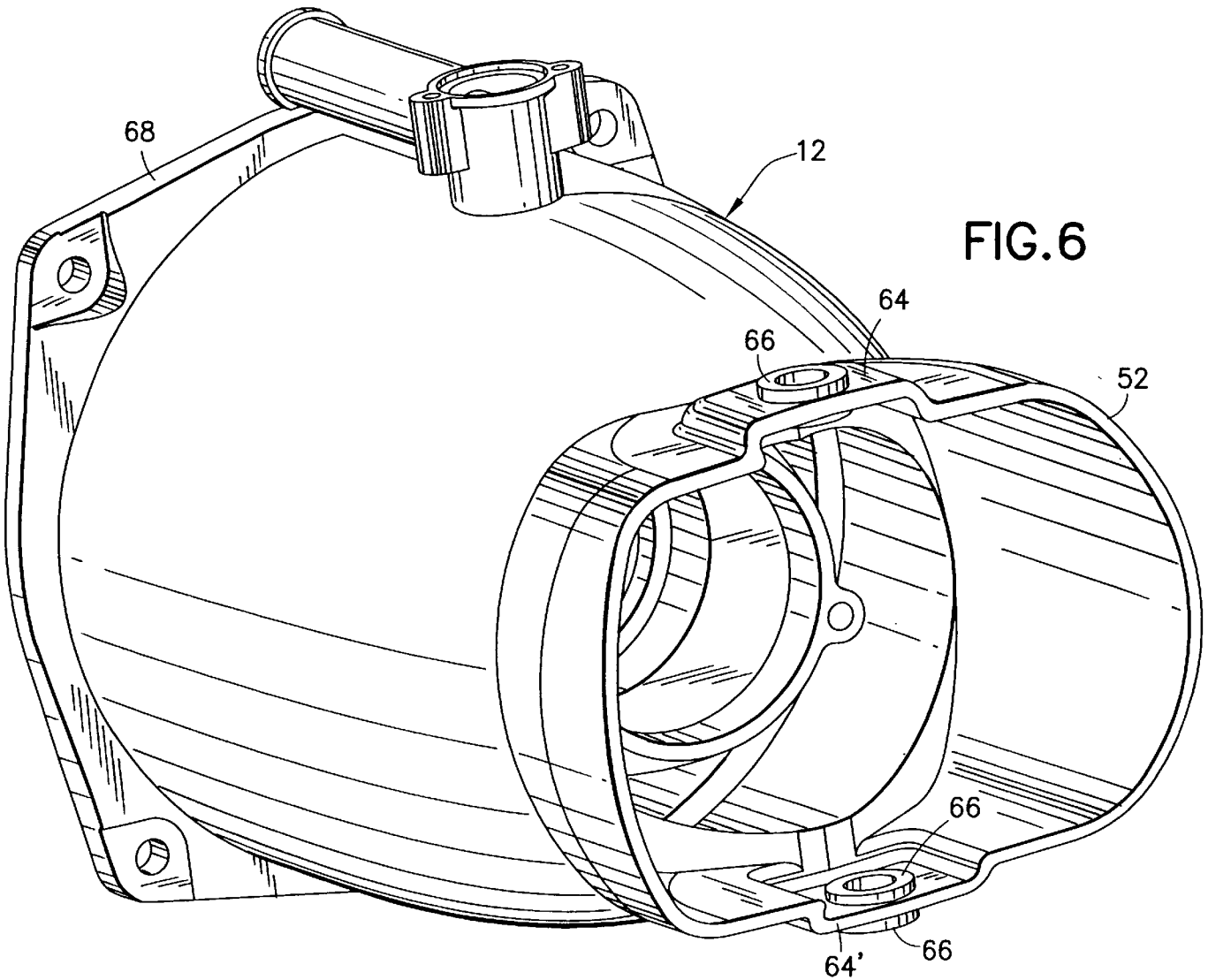
FIG. 6 is a schematic showing an isometric view of a housing in accordance with the preferred embodiment depicted in FIG. 2.
Figure 7:
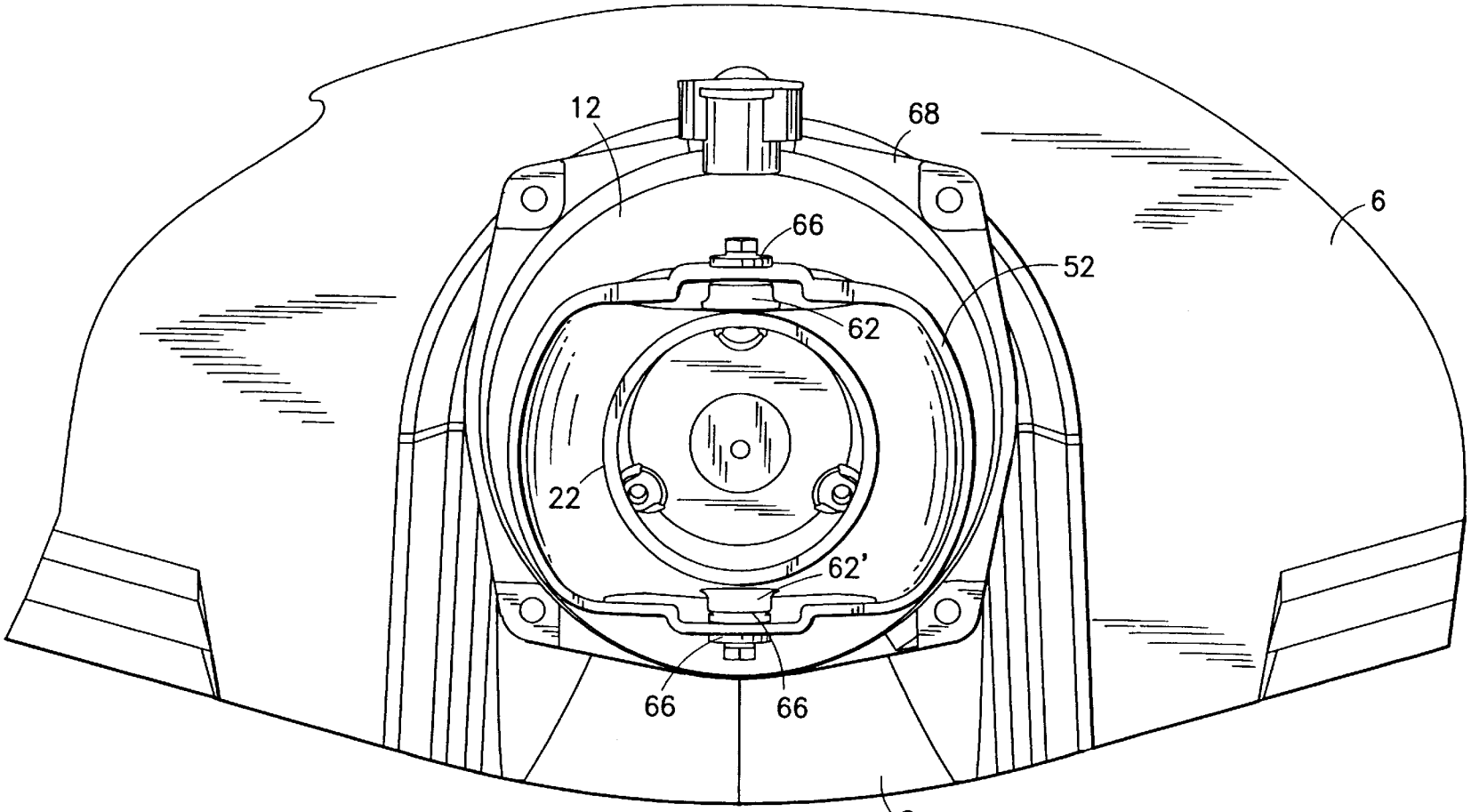
FIG. 7 is a schematic showing a rear elevational view of the water jet propulsion system of FIG. 2 mounted to a boat hull.

As seen in FIGS. 6 and 7, the cup-shaped extension 52 also has a width greater than its height. The top and bottom walls of extension 52 have respective recessed portions 64 and 64'. Each recessed portion has a respective hole in which the bushings 60 are installed (see FIG. 2). Each recessed portion 64 and 64' has a pair of bosses 66 which encircle the holes and reinforce the recessed portions on opposing sides thereof. The inner bosses 66 respectively abut the outer bosses 62 and 62' on the steering nozzle, as seen in FIG. 7. The housing 12 has a mounting flange 68 for attachment to the mounting adapter (14 in FIG. 1).

Figure 3:
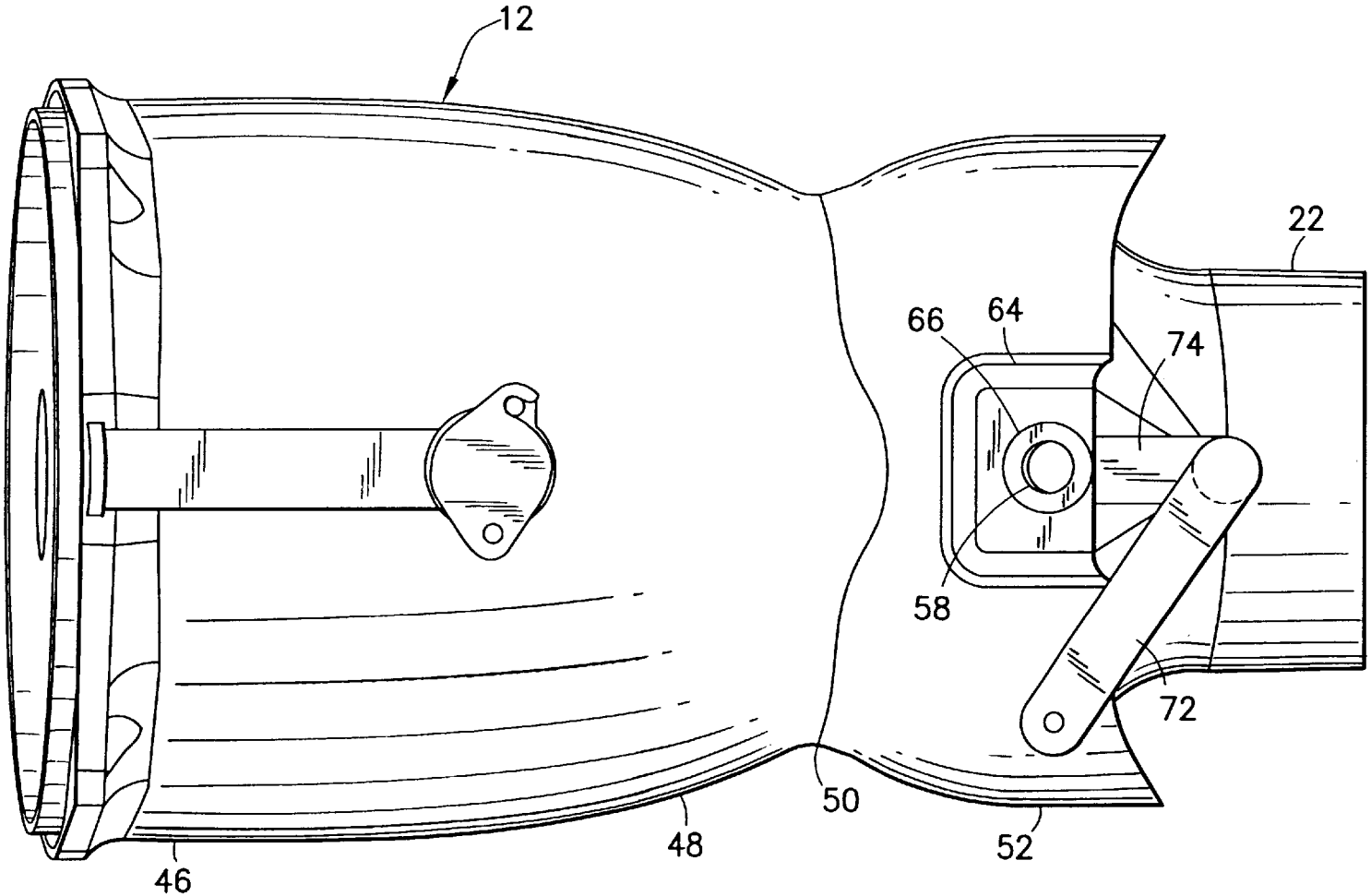
FIG. 3 is a schematic showing a top plan view of the water jet propulsion system depicted in FIG. 2.

As shown in FIGS. 2 and 3, preferably a support post 70 extends radially outward from the steering nozzle 22, and a steering arm 72 extends laterally and forward from the top of the support post. A distal portion of the steering arm 72 is located radially outward from the cup-shaped extension 52 and overhangs a portion of the latter, as best seen in FIG. 3.

Preferably the steering nozzle 22, support post 70 and steering arm 72 are formed as one cast piece. Optionally, a longitudinal reinforcement rib 74 is integrally formed on the exterior of the steering nozzle, integrally connected to the support post 70 and to the boss previously described (boss 62 seen in FIG. 5). The end of the steering arm has a clevis 78 with holes for a clevis pin (not shown). The clevis and pin are coupled to the end of a steering control rod (not shown) in conventional fashion. The steering control rod can be remotely operated by the boat operator by means of cables, levers and shafts in known manner. The steering nozzle is preferably pivotable about the pivot pin axis through angles of ±25 to 30 degrees. Although the steering arm 72 shown in FIG. 3 is disposed at an angle of about 60 degrees in FIG. 3, other angles can be used. As seen in FIG. 4, the mouth of the steering nozzle is much wider than the width of the discharge aperture 50 at the inlet opening. Then the steering nozzle passage converges rapidly. The wide mouth allows the steering nozzle to funnel the water discharge rearward at all angles through its range of rotation. Turning the steering nozzle to the port side causes the bow of the boat to turn to port; similarly, turning the steering nozzle to starboard causes the bow of the boat to turn in that direction.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

As used in the claims, the term "duct" means a fluid flow passage having an inlet and an outlet.

What is claimed is:

1. A water jet propulsion system comprising:

a flow-through housing comprising an impeller section, a convergent section rearward of said impeller section, and a cup-shaped extension extending from said convergent section;

an impeller which is rotatable within said impeller section of said housing; and a steering nozzle comprising an inlet opening with a substantially non-circular cross-section, a first section having a passage which laterally converges from said inlet opening in said rearward direction, and an outlet opening, said first section of said steering nozzle being pivotably mounted inside said cup-shaped extension for pivoting about an axis.

2. The system as recited in claim 1, wherein said outlet opening is generally circular.

3. The system as recited in claim 1, wherein said steering nozzle further comprises a second section having a passage which is generally cylindrical, said second section ending at said outlet opening, and said passage of said second section being in flow communication with said passage in said first section.

4. The system as recited in claim 1, wherein said steering nozzle comprises a second section having a passage which is convergent in said rearward direction, said second section ending at said outlet opening, and said passage of said second section being in flow communication with said passage in said first section.

5. The system as recited in claim 1, further comprising a support post extending radially outward from said steering nozzle and a steering arm extending laterally and forward from said support post, a portion of said steering arm being outside of and overhanging a portion of said cup-shaped extension.

6. The system as recited in claim 5, wherein said steering nozzle, said support post and said steering arm are formed as one cast piece.

7. The system as recited in claim 6, further comprising a longitudinal reinforcement rib integrally formed on the exterior of said steering nozzle and integrally connected to said support post.

8. The system as recited in claim 1, further comprising a pair of coaxial pivot pins for pivotably coupling said steering nozzle to said cup-shaped extension of said housing, wherein said steering nozzle has a centerline axis which is not perpendicular to the pivot axis.

9. The system as recited in claim 1, wherein said steering nozzle has a centerline axis which is not parallel to an axis of rotation of said impeller.

10. The system as recited in claim 1, wherein said cup-shaped extension extends rearward on its sides further than it extends rearward on its top and bottom.

11. The system as recited in claim 1, wherein said cup-shaped extension comprises top and bottom recesses and said steering nozzle comprises top and bottom bosses which protrude into said top and bottom recesses respectively.

12. A water jet propulsion system comprising:

a housing comprising a passage with forward and rearward open ends, said passage having a cross-sectional area which reaches a minimum at a point intermediate said forward and rearward open ends of said housing;

an impeller which is rotatable within said passage, said impeller being placed in a first section of said passage of said housing located forward of said point of minimum cross-sectional area; and a steering nozzle having a passage with a forward and rearward open ends, said passage of said steering nozzle comprising a first section which is laterally convergent beginning at said forward open end and extending for a predetermined distance in said rearward direction, said steering nozzle being pivotably mounted inside a second section of said passage of said housing located rearward of said point of minimum cross-sectional area, and said forward open end of said passage of said steering nozzle comprising an opening with a cross-sectional shape of a truncated circle forming a substantially oval-shape.

13. The system as recited in claim 12, wherein said rearward open end of said passage of said steering nozzle comprises an opening which is generally circular.

14. The system as recited in claim 12, wherein said passage of said steering nozzle further comprises a second section which is generally cylindrical and which terminates at said rearward open end of said passage of said steering nozzle.

15. The system as recited in claim 12, further comprising a support post extending radially outward from said steering nozzle and a steering arm extending laterally and forward from said support post.

16. The system as recited in claim 15, wherein said steering nozzle, said support post and said steering arm are formed as one cast piece.

17. The system as recited in claim 16, further comprising a longitudinal reinforcement rib integrally formed on the exterior of said steering nozzle and integrally connected to said support post.

18. The system as recited in claim 12, further comprising a pair of coaxial pivot pins for pivotably coupling said steering nozzle to said housing, wherein said steering nozzle has a centerline axis which is not perpendicular to the pivot axis.

19. The system as recited in claim 12, wherein said steering nozzle has a centerline axis which is not parallel to an axis of rotation of said impeller.

20. The system as recited in claim 12, wherein said passage of said housing further comprises a third section located between said first section of said passage of said housing and said point of minimum cross-sectional area, said third section of said passage being convergent.

21. The system as recited in claim 20, further comprising a stator located within said third section of said passage of said housing, said stator comprising a stator hub and a plurality of stator vanes.

22. The system as recited in claim 21, further comprising means for rotatably supporting said impeller, said means being housed inside said stator hub.

23. A water jet propulsion system comprising:

a duct comprising a convergent section having a discharge aperture at its rearward end;

an open-ended extension extending rearward from said convergent section and containing top and bottom recesses; and a steering nozzle pivotably mounted to said extension and having a passage with forward and rearward open ends, said passage comprising a first section which is laterally convergent beginning at said forward open ends and extends for a predetermined distance in said rearward direction, said forward open end of said passage residing inside said extension and comprising top and bottom bosses that protrude into the top and bottom recesses respectively.

24. The system as recited in claim 23, wherein said rearward open end of said passage of said steering nozzle comprises an opening which is generally circular.

25. The system as recited in claim 23, wherein said passage of said steering nozzle further comprises a second section which is generally cylindrical, said second section ending at said rearward open end of said passage of said steering nozzle.

26. The system as recited in claim 23, further comprising a support post extending radially outward from said steering nozzle and a steering arm extending laterally and forward from said support post.

27. The system as recited in claim 26, wherein said steering nozzle, said support post and said steering arm are formed as one cast piece.

28. The system as recited in claim 26, wherein said steering post is displaced rearward relative to a pivot point of said steering nozzle.

29. The system as recited in claim 26, further comprising a longitudinal reinforcement rib integrally formed on the exterior of said steering nozzle and integrally connected to said support post.

30. The system as recited in claim 29, further comprising a boss formed on said exterior of said steering nozzle, said boss surrounding a hole formed in said steering nozzle and being integrally formed with said reinforcement rib.

31. The system as recited in claim 23, further comprising a pair of coaxial pivot pins for pivotably coupling said steering nozzle to said extension, wherein said steering nozzle has a centerline axis which is not perpendicular to the pivot axis.

32. The system as recited in claim 23, wherein said duct and said extension are formed as one cast piece.

33. A jet-propelled boat comprising:

a hull;

an inboard motor;

a duct mounted to said hull;

an open-ended extension connected to a rear end of said duct, an impeller rotatable within said duct;

a shaft coupling said impeller to said motor, said shaft penetrating said hull, and a steering nozzle pivotably mounted to said extension, said steering nozzle having an inlet end which resides inside said extension, said inlet end of said steering nozzle comprising an inlet opening having a width in one direction substantially greater than a height in another direction and a pair of extruded bosses centered on the axis of rotation configured to insert into respective recesses of the extension.

34. The boat as recited in claim 33, wherein said steering nozzle has a centerline axis which is not parallel to an axis of rotation of said impeller.

35. The boat as recited in claim 33, further comprising a support post extending radially outward from said steering nozzle and a steering arm extending laterally and forward from said support post, a portion of said steering arm being outside of and overhanging a portion of said duct.

36. The boat as recited in claim 33, wherein said rear end of said duct is convergent and said inlet end of said steering nozzle is laterally convergent.

37. A water jet propulsion system comprising:

a flow-through housing comprising an impeller section, a convergent section rearward of said impeller section, and a cup-shaped extension extending from said convergent section;

an impeller which is rotatable within said impeller section of said housing;

a steering nozzle comprising an inlet opening with a substantially non-circular cross-section, a first section having a passage which laterally converges from said inlet opening in said rearward direction, and an outlet opening, said first section of said steering nozzle being pivotably mounted inside said cup-shaped extension for pivoting about an axis;

a support post extending radially outward from said steering nozzle and a steering arm extending laterally and forward from said support post, a port of said steering arm being outside of and overhanging a portion of said cup-shaped extension wherein said steering nozzle, said support post, and said steering arm are formed as one case piece; and a longitudinal reinforcement rib integrally formed on the exterior of said steering nozzle and integrally connected to said support post.

38. A water jet propulsion system comprising:

a flow-through housing comprising an impeller section, a convergent section rearward of said impeller section, and a cup-shaped extension extending from said convergent section;

an impeller which is rotatable within said impeller section of said housing; and a steering nozzle comprising an inlet opening with a substantially non-circular cross-section, a first section having a passage which laterally converges from said inlet opening in said rearward direction, and an outlet opening, said first section of said steering nozzle being pivotably mounted inside said cup-shaped extension for pivoting about an axis, wherein said cup-shaped extension comprises top and bottom recesses and said steering nozzle comprises top and bottom bosses which protrude into said top and bottom recesses respectively.

* * * * *